US006006767A

United States Patent [19]

Hecker et al.

[11] Patent Number: 6,006,767

[45] Date of Patent: Dec. 28, 1999

[54] DOOR/SILL INTERFACE FOR A WAREWASHER

[75] Inventors: Dean A. Hecker; Walter L. DeBrosse, both of Piqua, Ohio

[73] Assignee: Premark FEG L.L.C., Wilmington, Del.

[21] Appl. No.: 09/146,899

[22] Filed: Sep. 3, 1998

Related U.S. Application Data

[60] Provisional application No. 60/058,089, Sep. 5, 1997.

[51] Int. Cl.[6] ..... B08B 3/02

[52] U.S. Cl. ..... 134/183; 134/200; 134/201

[58] Field of Search ..... 134/201, 57 DL, 134/200, 56 D, 57 D, 58 D, 183, 182, 104.2; 49/469, 470

[56] References Cited

U.S. PATENT DOCUMENTS

| | | | |
|---|---|---|---|
| 1,495,473 | 5/1924 | Fitzgerald | 134/200 |
| 3,166,082 | 1/1965 | Arnold et al. | 134/200 |
| 3,221,754 | 12/1965 | Robson et al. | 134/68 |
| 3,310,150 | 3/1967 | Southard | 198/24 |
| 3,384,097 | 5/1968 | Meeker et al. | 134/46 |
| 3,468,486 | 9/1969 | Mercer | 134/183 |
| 3,571,939 | 3/1971 | Paul | 34/1 |
| 3,624,750 | 11/1971 | Peterson | 134/200 |
| 4,018,239 | 4/1977 | Caldwell et al. | 134/200 |
| 4,179,821 | 12/1979 | Herbst et al. | 34/235 |
| 4,439,242 | 3/1984 | Hadden | 134/25.2 |
| 4,608,780 | 9/1986 | Van Noy | 134/200 |
| 4,678,227 | 7/1987 | Castagno | 296/213 |
| 4,750,503 | 6/1988 | Noren | 134/57 DL |
| 5,115,826 | 5/1992 | Bertsch et al. | 134/183 |
| 5,178,172 | 1/1993 | Morley | 134/183 |
| 5,329,952 | 7/1994 | Kojima et al. . | |
| 5,630,438 | 5/1997 | Hoover et al. | 134/20 |
| 5,642,742 | 7/1997 | Noren et al. | 134/57 |
| 5,836,324 | 11/1998 | Johnson | 134/58 D |

OTHER PUBLICATIONS

Hobart *UW–50 Utensil Washer* Product Brochure.
Hobart *UW–50 Utensil Washer* Product Brochure, Jan. 1994.

*Primary Examiner*—Frankie L. Stinson
*Attorney, Agent, or Firm*—Thompson Hine & Flory LLP

[57] ABSTRACT

A joint for forming a seal between a warewasher and the bottom of a generally rectangular, vertically movable door housed in the warewasher to inhibit release of moisture into the ambient atmosphere. The door has an outer face and is shaped to cover a generally rectangular opening in the warewasher. The joint includes a sill located along the bottom edge of the opening having a downwardly angled surface to retain moisture in the warewasher and an upper assembly located along the lower edge of the outer face including a handle shaped to mate with the sill. The upper assembly further includes a downwardly extending saddle shaped to cover the interface between the handle and the sill to facilitate the retention of moisture in the warewasher.

6 Claims, 5 Drawing Sheets

DOOR/SILL INTERFACE FOR A WAREWASHER

CROSS REFERENCE TO RELATED APPLICATIONS

This application claims priority under 35 U.S.C. § 119 from provisional application Ser. No. 60/058,089 filed Sep. 5, 1997, the entire disclosure of which is incorporated herein by reference.

BACKGROUND

The present invention relates to a warewasher having an access door that abuts against a lower sill of the warewasher, the door and the sill being shaped to inhibit moisture from escaping from the warewasher when the door is closed against the sill.

BACKGROUND OF THE INVENTION

Commercial conveyer-type warewashers typically include a long, rectangular chamber through which the ware travels, and an endless conveyor which transports the ware through the chamber. The washer may include a series of stations within the inner chamber to effect different stages of the washing process. Examples of these stages include the pre-rinse, wash, rinse, dry as well as other cycles which are carried out at different locations in the warewasher as the ware is transported along the conveyor. In warewashers of this type, it is often desired to allow the operator access to the inner chamber to detect and correct jams, observe the cleanliness of the ware, as well as inspect, service, and maintain various components of the warewasher.

Accordingly, access to the warewasher is typically provided by a series of large, rectangular doors located on the sides of the washer. The doors are typically moveable in the vertical direction to offer access to the inner chamber and include a seal around the periphery of the door to secure steam and water in the warewasher chamber when the door is in the closed position. Warewashers use a large volume of agitated, hot water, and therefore it is imperative that the access doors form an effective seal with the warewasher to retain heat and moisture in the washer. Furthermore, due to the demands attendant with commercial use, the sealing mechanism must be capable of withstanding prolonged exposure to heat and moisture enclosed by the warewasher. Accordingly, there exists a need for a door/warewasher interface which forms an effective seal, which can withstand the harsh environment of a warewasher, and which inhibits the release of steam and moisture from the chamber to the ambient environment.

SUMMARY OF THE INVENTION

The present invention is a warewasher having a joint for forming a seal between the warewasher and the bottom of a generally rectangular, vertically moveable door housed in the warewasher. The seal of the present invention effectively retains heat and moisture within the warewasher and effectively resists corrosion, even when exposed to repeated cycles of the warewasher.

More particularly, the present invention provides a joint for forming a seal between a warewasher and the bottom of a generally rectangular, vertically movable door housed in the warewasher. The door has an outer face and is shaped to cover a generally rectangular opening in the warewasher. The joint comprises a sill located along the bottom edge of the opening, the sill having a downwardly angled surface to help direct any escaping moisture back into the warewasher. The joint further comprises an upper assembly located along the lower edge of the outer face of the warewasher. The upper assembly includes a handle shaped so as to mate with the sill, and a downwardly extending saddle shaped to cover the interface between the handle and the sill to retain moisture in the warewasher. Using this arrangement, moisture is inhibited from escaping from the warewasher.

These and other objects and advantages of the present invention will be more fully understood and appreciated by reference to the following description, the accompanying drawings and the appended claims.

DETAILED DESCRIPTION

Figure 8:
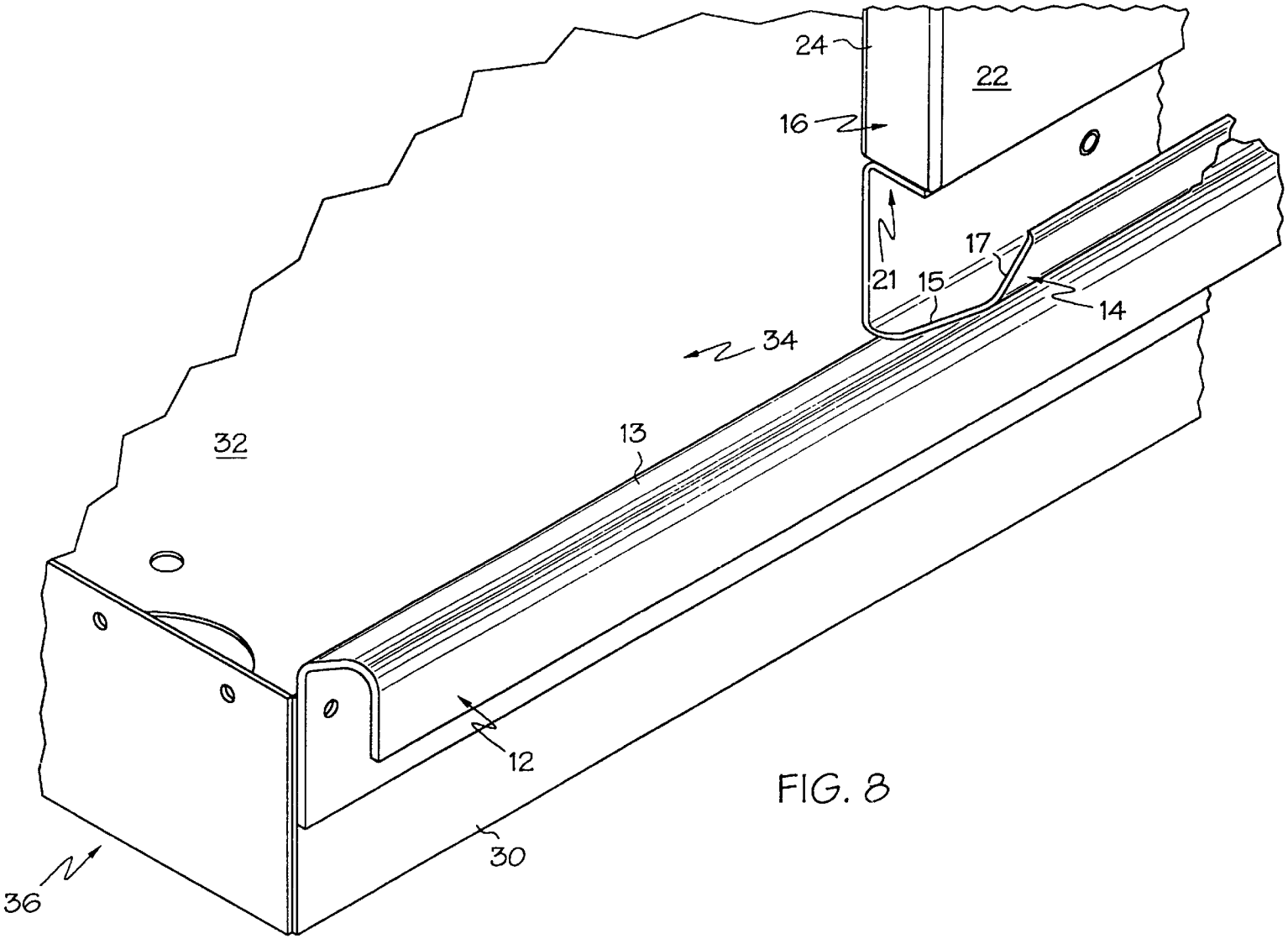
FIG. 8 is a perspective view of the joint of FIG. 1.

The present invention is preferably employed in an elongated conveyor warewasher which is used for washing, sanitizing and rinsing ware. As shown in FIG. 8, a warewasher 36 for use with the door/sill interface of the present invention includes an outer housing 30 and a longitudinally-oriented chamber 32 formed in the housing 30 through which the ware passes. A generally rectangular access opening 34 is formed in the housing 30 to provide access into the chamber 32. A door 16 is provided for sealing the chamber 32 from the ambient atmosphere during operation of the warewasher 36. A handle 14 is positioned on the bottom of the door 16 to facilitate access to the chamber 32 and is shaped to mate with a sill 12 positioned on the lower portion of the housing 30 below the access opening 34.

Figure 1:
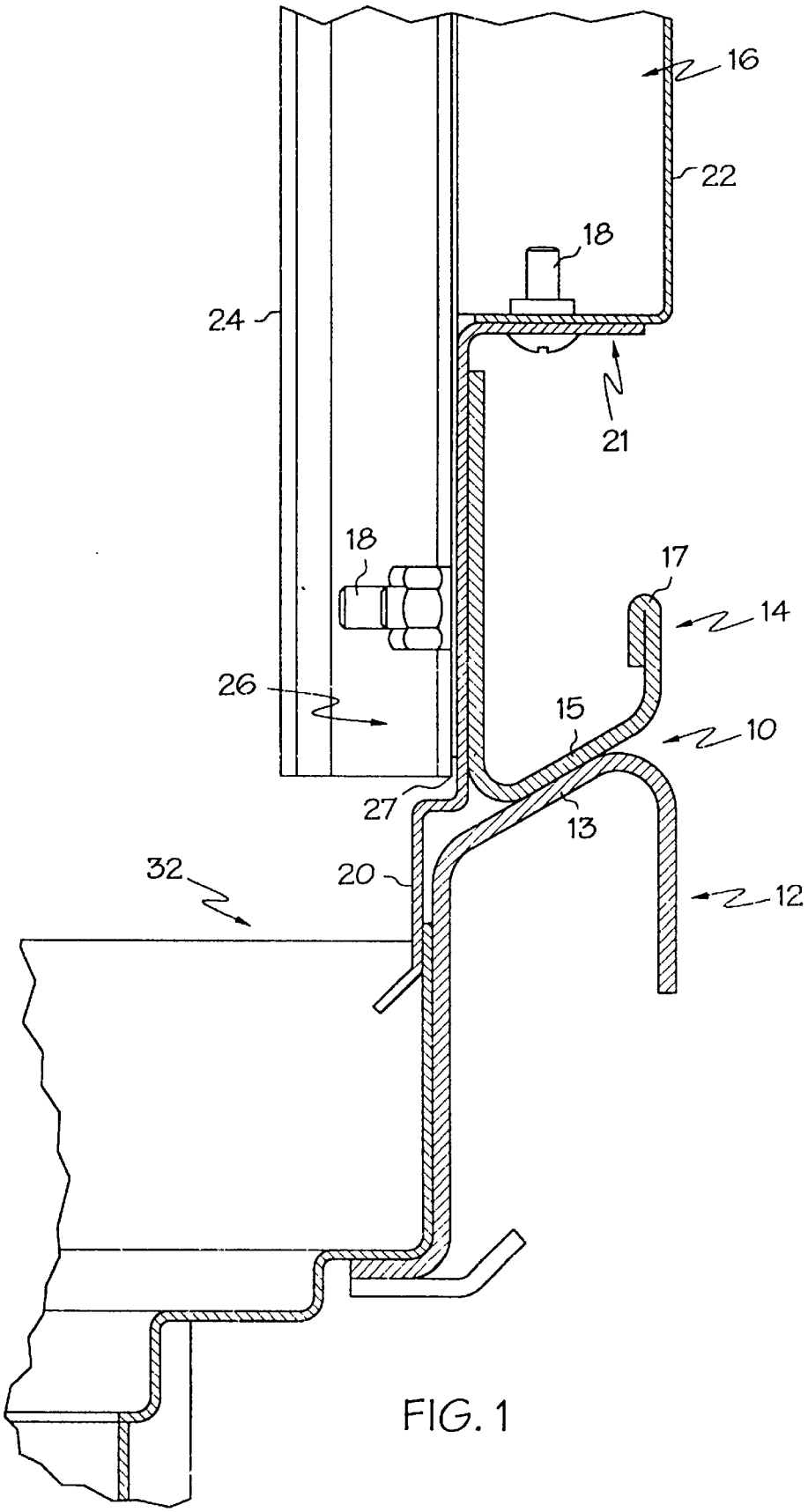
FIG. 1 is a side elevational view of the door/sill interface for a warewasher of the present invention.

As shown best in FIG. 1, a joint 10 is formed at the interface between the sill 12 and the handle 14. The handle 14 is rigidly connected to the door 16 by a series of threaded fasteners 18. The handle 14 includes a downwardly angled surface 15 which mates with a corresponding downwardly angled surface 13 on the sill 12. Handle 14 includes grip portion 17, which provides a convenient surface for a user to grip when closing or opening the door 16 to gain access to the chamber 32.

Figure 2:
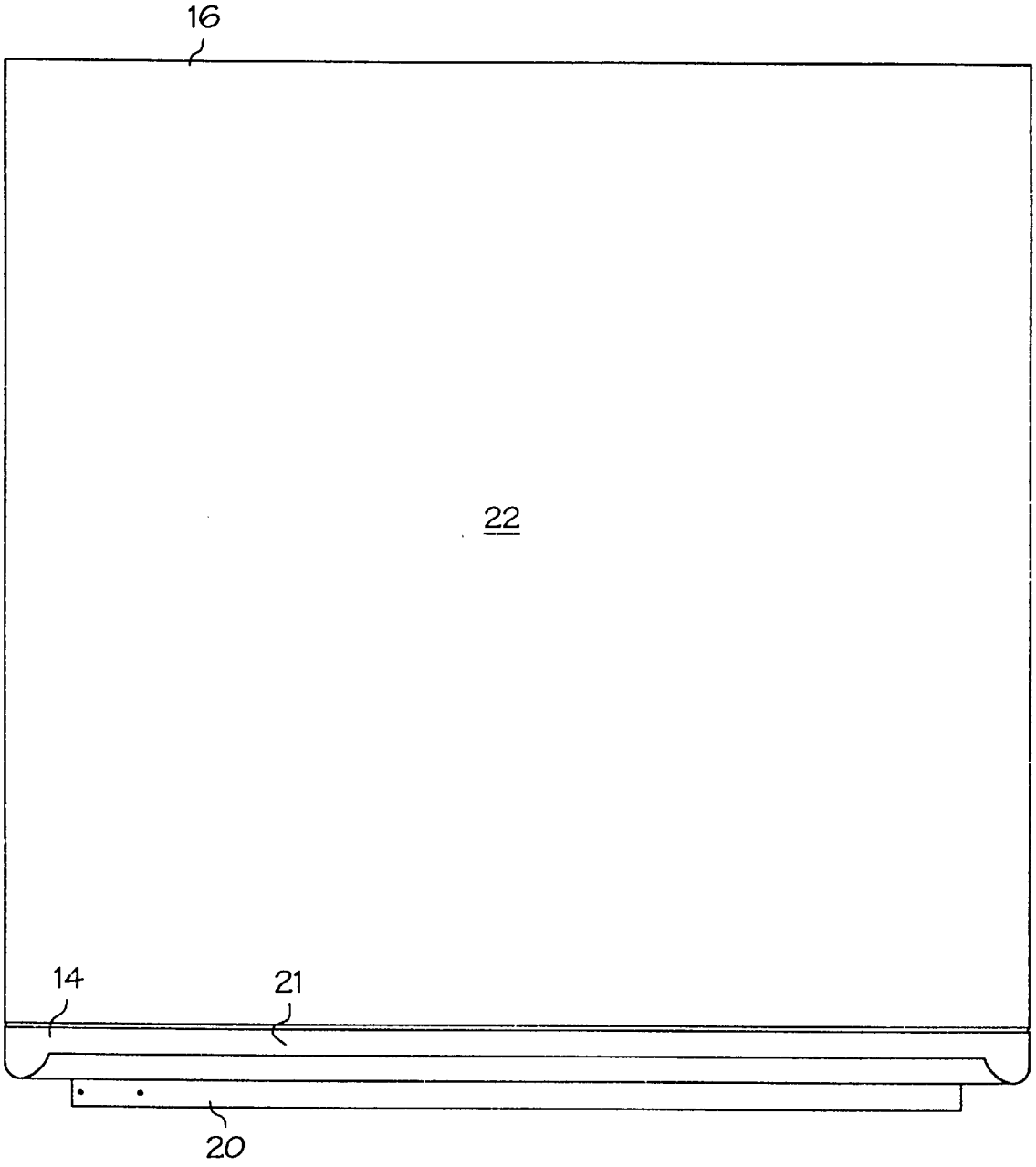
FIG. 2 is a front elevational view of the door of the present invention.
Figure 3:
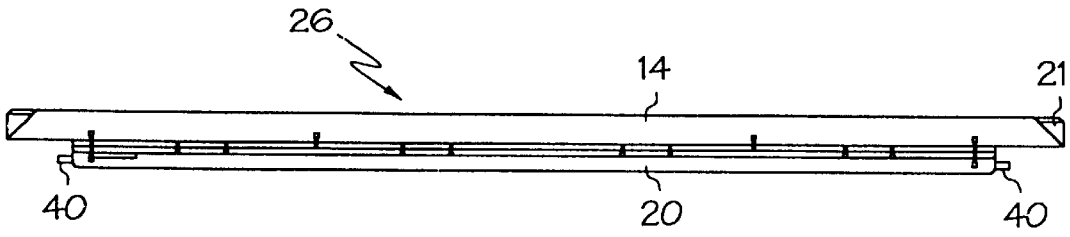
FIG. 3 is a bottom plan view of the door of FIG. 2.
Figure 4:
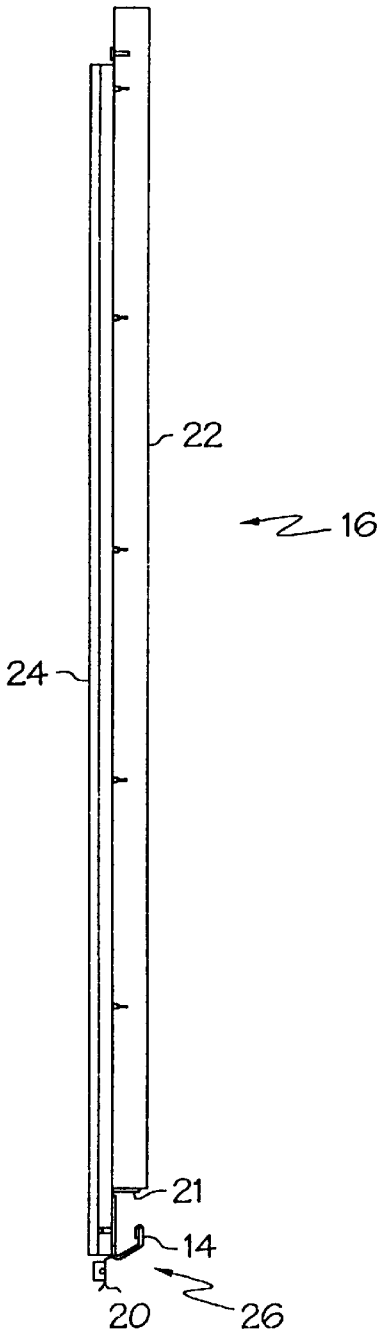
FIG. 4 is a side elevational view of the door of FIG. 2.
Figure 5:
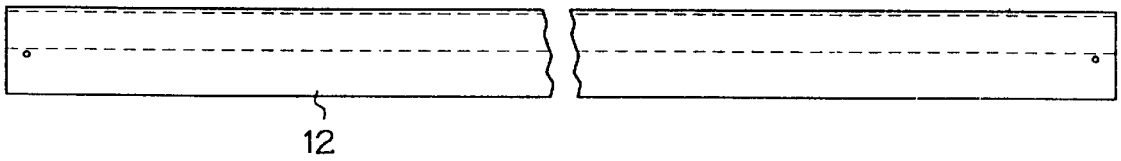
FIG. 5 is a front plan view of the sill of the present invention.
Figure 6:
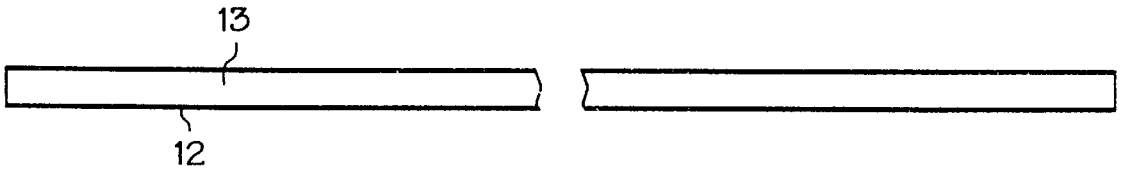
FIG. 6 is a top plan view of the sill of FIG. 5.
Figure 7:
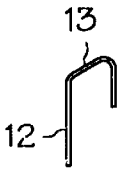
FIG. 7 is an end elevational view of the sill of FIG. 5.

Door 16 has an outer face 22 which is exposed to the ambient atmosphere and an inner face 24 which is exposed to the interior of the warewasher 36. The door 16 includes an upper assembly 26 made up of a saddle 20, which extends downwardly into the chamber 32, and the handle 14. The saddle 20 is shaped to extend below the joint 10 when the door 16 is in the closed position, thereby inhibiting the release of moisture from the chamber 32 to the ambient atmosphere. The upper assembly 26 is attached along the lower edge 27 of the door 16, and is preferably formed from steel. As shown in FIGS. 2, 3 and 4 ,the door 16 is notched 21 along its lower edge to provide a surface for mounting the upper assembly 26.

The sill 12, as shown best in FIGS. 1, 5, 6 and 7, has a downwardly angled surface 13 which is shaped to mate with the downwardly angled surface 15 of the handle 14 in order to retain moisture in the warewasher. During operation of the warewasher 36, it is common for moisture escaping from the chamber 32 to condense on the surface 13 of the sill 12. In prior art warewashers, this condensation had a tendency to be blown into the ambient atmosphere, thereby decreasing the efficiency of the warewasher and generally making a mess in the surrounding work area. However, due to the downwardly angled surface 13 of the sill 12, in the present invention this condensation has a tendency to flow downward, by force of gravity, back into the warewasher.

As shown in FIG. 1, when the door 16 is in the closed position, the handle 14 mates with the sill 12 to form an effective seal 10. To further aid in retaining moisture and heat, the saddle 20 covers the joint 10. As shown best in FIG. 3, the door 16 preferably includes a pair of outwardly-extending flanges 40 along its sides. The flanges 40 fit within guide slots (not shown) formed in the housing along the side of the access opening 34 to guide the vertical movement of the door 16.

While the forms of apparatus herein described constitute a preferred embodiment of the invention, it is to be understood that the present invention is not limited to these precise forms and that changes may be made therein without departing from the scope of the invention.

What is claimed is:

1. A door/sill interface for a warewasher comprising:

an outer housing;

a chamber formed in said housing through which ware may pass;

a generally rectangular access opening formed in said housing which opens into said chamber;

a sill located along the bottom edge of said opening, said sill having a downwardly angled and inwardly canted surface to inhibit the release of moisture through said opening from said chamber;

a generally rectangular, vertically movable door shaped and positioned to cover said access opening when said door is closed, said door having an outer face and a lower edge; and an upper assembly located along the lower edge of said outer face, said upper assembly including a handle shaped to mate with said sill thereby forming a seal between said sill and said handle, and a downwardly extending saddle extending into said chamber shaped to cover the interface between said handle and said sill when said door is closed.

2. The a door/sill interface for a warewasher of claim 1 wherein said sill and said upper assembly are made of steel.

3. The a door/sill interface for a warewasher of claim 2 wherein said door includes a notch at its lower edge, said upper assembly being mounted in said notch.

4. The a door/sill interface for a warewasher of claim 3 wherein said upper assembly is mounted to said door by threaded fasteners passing through said upper assembly and into said door.

5. The a door/sill interface for a warewasher of claim 4 further comprising a pair of flanges mounted to the sides of said door, said flanges being received in cooperating slots formed in said housing to thereby guide the vertical movement of said door.

6. The a door/sill interface for a warewasher of claim 5 wherein said handle includes a grip portion which provides a convenient surface for gripping said door.

* * * * *

UNITED STATES PATENT AND TRADEMARK OFFICE

CERTIFICATE OF CORRECTION

| | | |
|---|---|---|
| PATENT NO. | : | 6,006,767 |
| DATED | : | December 28, 1999 |
| INVENTOR(S) | : | Dean A. Hecker et al. |

It is certified that error appears in the above-identified patent and that said Letters Patent is hereby corrected as shown below:

Claim 2, col. 4, line 15, after "The" delete --a--.

Claim 3, col. 4, line 17, after "The" delete --a--.

Claim 4, col. 4, line 21, after "The" delete --a--.

Claim 5, col. 4, line 25, after "The" delete --a--.

Claim 6, col. 4, line 31, after "The" delete --a--.

Signed and Sealed this

Twenty-fourth Day of October, 2000

*Attest:*

Q. TODD DICKINSON

*Attesting Officer*

*Director of Patents and Trademarks*